US005361448A

United States Patent [19]

Chao

[11] Patent Number: 5,361,448

[45] Date of Patent: Nov. 8, 1994

[54] DEWATERING DEVICE FOR A SWAB

[76] Inventor: Shu H. A. Chao, 18F-1, No. 155, Sec. 4, Hsinyi Rd., Taipei,

[21] Appl. No.: 58,121

[22] Filed: May 10, 1993

[51] Int. Cl.[5] ..... A47L 13/58

[52] U.S. Cl. ..... 15/263

[58] Field of Search ..... 15/260, 263, 120.1, 15/120.2, 116; 100/238; 68/243

[56] References Cited

U.S. PATENT DOCUMENTS

| | | | |
|---|---|---|---|
| 577,976 | 3/1897 | Carter | 100/238 |
| 668,102 | 2/1901 | Johnson | 15/263 |
| 2,042,892 | 6/1936 | Granger | 15/120.2 |
| 2,365,437 | 12/1944 | Schaefer | 15/120.2 |
| 2,524,192 | 10/1950 | Harget | 15/228 |
| 4,464,807 | 8/1984 | Weiss | 15/120.2 |

*Primary Examiner*—David A. Scherbel
*Assistant Examiner*—Tony G. Soohoo
*Attorney, Agent, or Firm*—Bacon & Thomas

[57] ABSTRACT

A dewatering device for a swab, particularly a device to twist and dewater a swab by placing the swab in the dewatering device which has a guide element incorporated with a guide device at each lateral side engaging with a spiral groove provided on the inner wall of the dewatering device. An expansion pipe, composed of several sleeves and a compression spring located within the sleeves, is placed beneath the guide element. By placing the swab across the guide element and applying a downward force, the guide element rotates to twist the swab, and consequently extract water from the swab.

12 Claims, 5 Drawing Sheets

DEWATERING DEVICE FOR A SWAB

BACKGROUND OF THE INVENTION

The present invention relates to a dewatering device, particularly a device to twist and extract water from a swab.

Cleaning is an indispensable chore in every family, and a chore which every person has to do, but generally home cleaning work is the duty of every mother. If the mother has her own occupation, then cleaning is a time and labor exhaustive work for her after office hours, she has a lot of chores to be done at home, she has to clean the floor once every two or three days, during which she as to sweep, swab and then extract water from the swab she uses.

There is a simple swab drier in the market, a structure of a hopper-like body made at a side of a water container, to which a swab can be placed and then the handle of the swab is twisted so that excessive water adhered to the swab can be extracted. However, the water container may fall down if force is applied improperly, and water in the swab cannot be removed thoroughly.

In view of the above defect, the inventor has invented a dewatering device for a swab.

SUMMARY OF THE INVENTION

The main objective of the present invention is to provide a dewatering device for a swab, particularly a device with a guide element having a guide device at each lateral side corresponding to a spiral groove on the inner wall of the dewatering device in order that the guide element can rotate and twist a swab placed on it when a downward force is applied to the swab in order to dewater the swab.

BRIEF DESCRIPTION OF THE INVENTION

Other objectives, structures, functions and purposes of the present invention are more apparent in the description below which is made with reference to the following drawings, in which FIG. 1 is a sectional view of a dewatering device for a swab according to the present invention;

DETAILED DESCRIPTION OF THE PREFERRED EMBODIMENT

Figure 1:
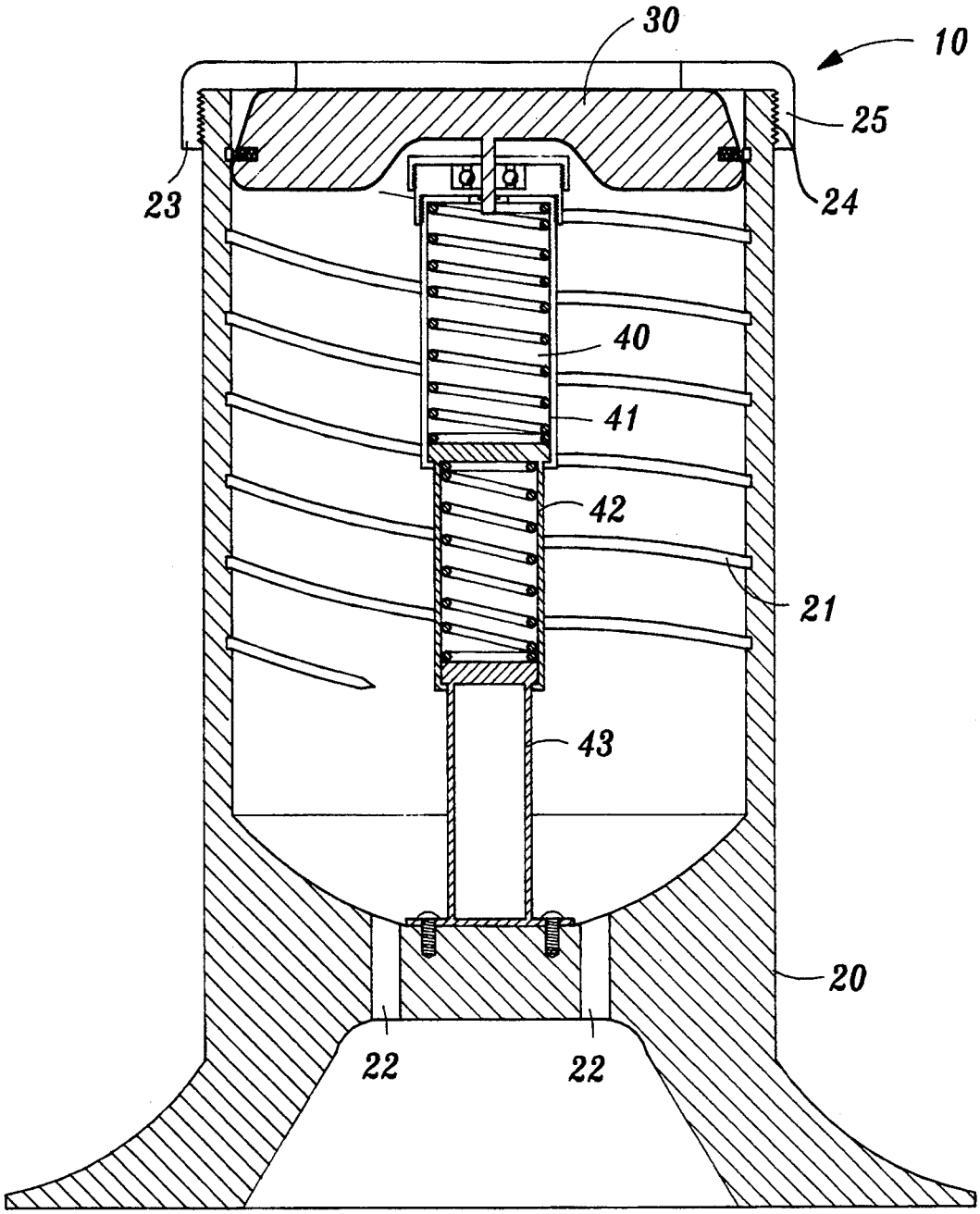

Please refer to the attached drawings, the dewatering device 10 for a swab according to the present invention comprises a body 20, a guide element 30, and an expansion pipe 40. The body 20 is a hollow structure with an outer thread 23 on its external wall for connecting to an upper cover 25 provided with an inner thread 24. The body 20 has a spiral groove 21 for installation of the guide element on the body 20. Each lateral side of guide element 30 has a hole 32 for insertion of a guide device 31. The guide device 31 is comprised of a compression spring 311 and a T-block 312. The T-block is made of two circular blocks of varying diameters, while the large diametric block is engaged with the spiral groove 21. Please refer to FIG. 2A which depicts a sectional view of another embodiment of guide device 30 comprised of a compression spring 311 and a ball 313 arranged in a manner such that one-third to two-fifths of the ball 313 is exposed out of the hole 32 so that the ball 313 is engaged with spiral groove 21. Please also refer to FIG. 2B for another embodiment of the guide device 30 which is comprised of a compression spring 311, a T-block 313 and a ball 312. Ball 312 is adapted to be engaged with spiral groove 21.

Figure 2:
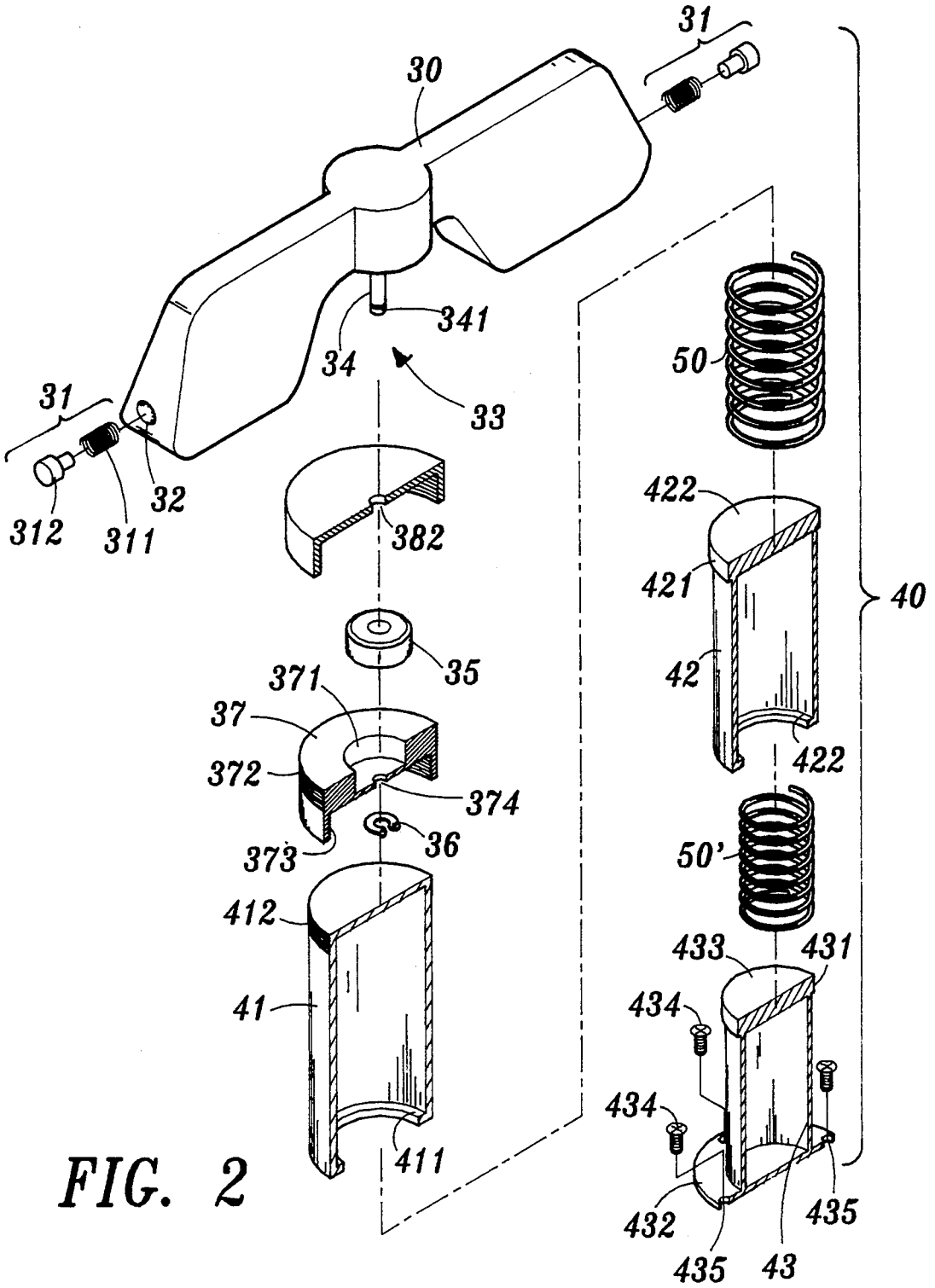
FIG. 2 is a fragmental view of the dewatering device for a swab according to the present invention.
Figure 2B:
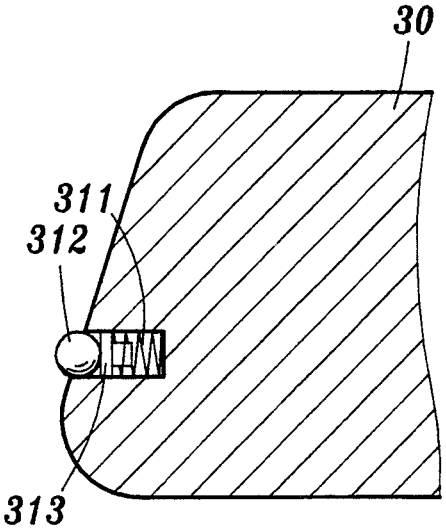
FIG. 2B is a sectional view of another embodiment of a guide device according to the present invention.
Figure 2A:
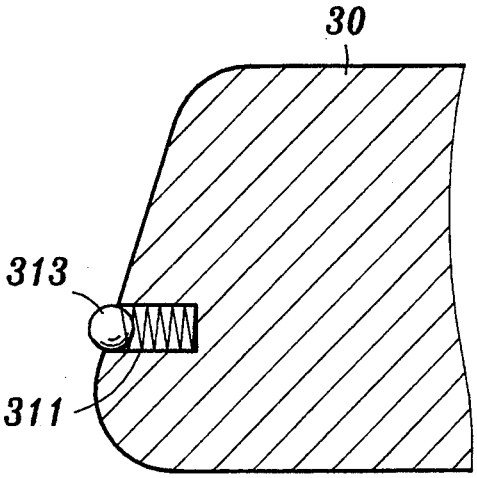
FIG. 2A is a sectional view of another embodiment of a guide device according to the present invention.

As shown in FIG. 2, a recess 371 is formed at an appropriate position in the middle of a support 37 for carrying a bearing 35. The support 37 has an outer thread 372 on its outer wall for fitting of a U-like cover 38 which has an inner thread 381 to engage with the outer thread 372. The guide element 30 has a recessed area generally indicated at 33 from which projects a spindle 34 at the center thereof that is adapted to pass through two holes 382 and 374. A retainer ring 36 is used to retain the spindle 34 by engaging an annular groove 341. The support 37 has an inner thread 373 on the inner wall of its bottom for fitting a first sleeve 41 by engaging with its outer thread 412.

The expansion pipe 40 is composed of the first sleeve 41, a second sleeve 42 and a third sleeve 43. The second sleeve 42 is designed with an outer lug 421 at the top end to connect to an inner lug 411 of the first sleeve 41, and the third sleeve 43 has an outer lug 431 at the top end to connect to an inner lug 422 of the second sleeve 42. The upper side of the second sleeve 42 is formed with a flat end wall portion 422. A compression spring 50 is placed on the flat end wall portion 422 and located within the first sleeve 41. The upper side of the third sleeve 43 also includes a flat end wall portion 433. Another compression spring 50' is placed on flat end wall portion 433 and located within the second sleeve 42. The third sleeve 43 is designed with a flange 432 on the bottom. Along the flange 432 there is a plurality of screw holes 435 for securing expansion pipe 40 to the inner wall of the body 20 by means of bolts 434.

Figure 3:
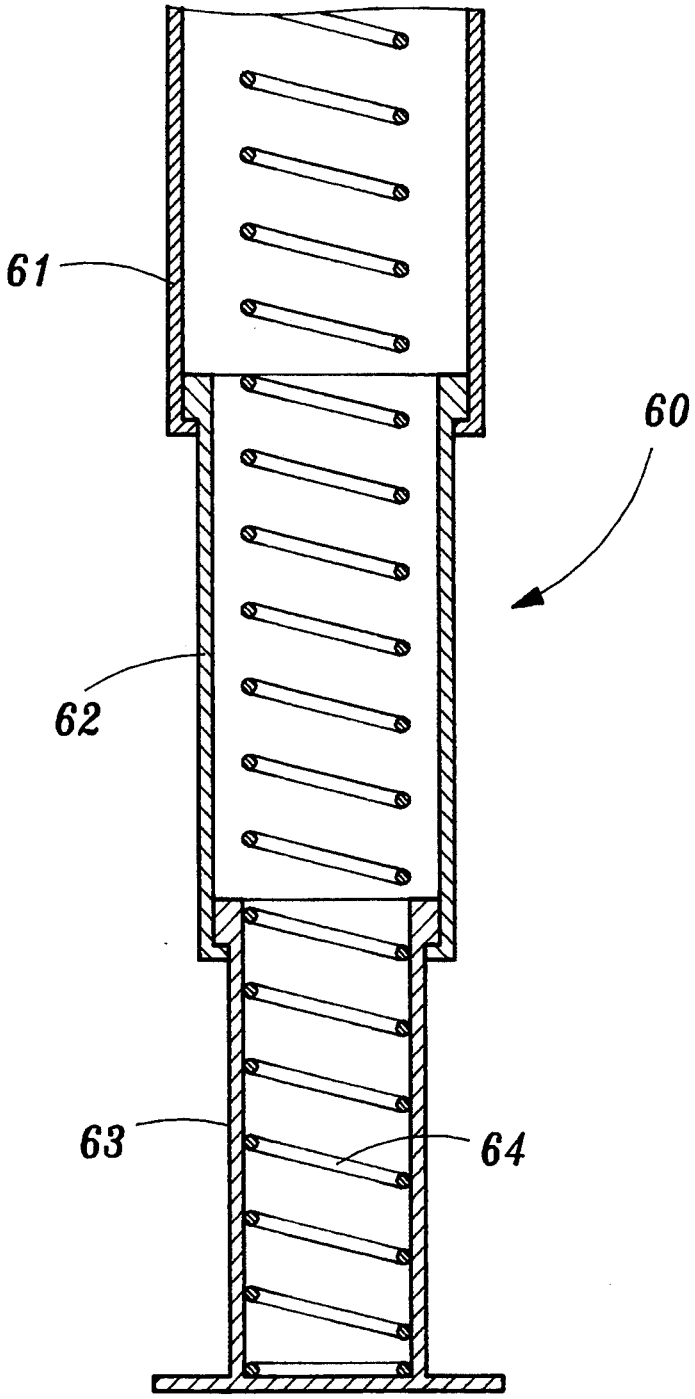
FIG. 3 is a sectional view of another embodiment of an expansion pipe according to the present invention.

Please refer to FIG. 3 for a sectional view of another embodiment of an expansion pipe 60 according to the present invention. It is different from the embodiment described above in the design of the second sleeve 62 and the third sleeve 63. These sleeves 62 and 63 are open at their respective upper sections for holding a compression spring 64 in the first, second and third sleeves 61,62, and 63.

Figure 4:
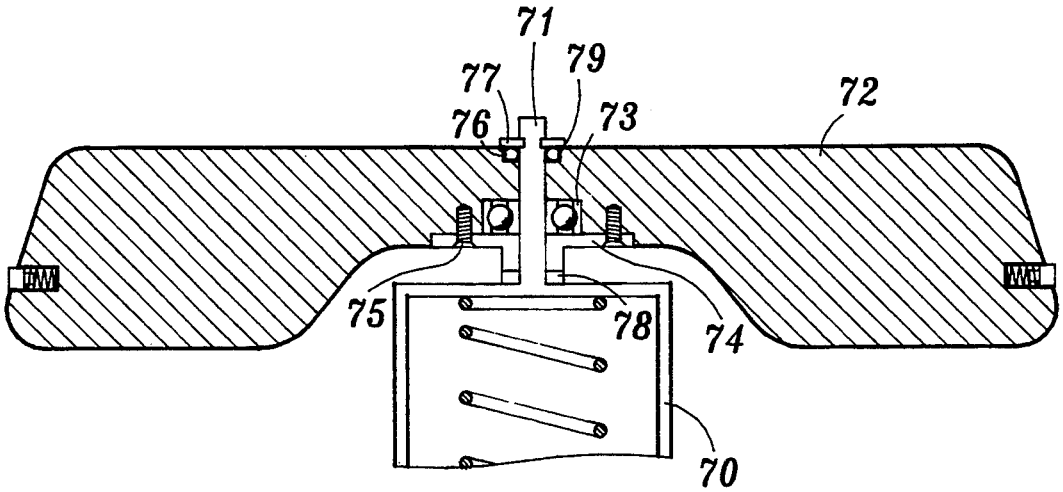
FIG. 4 is a sectional view of another embodiment of an assembly of the guide element and the expansion pipe according to the present invention.

Please refer to FIG. 4 for a sectional view of another embodiment of an assembly of the guide element 72 and the first sleeve 70 according to the present invention. The first sleeve 70 has a spindle 71 that extends upward from its top end. The guide element 72 is provided with a bearing 73 at a lower portion thereof. The bearing 73 is held in place by a T-like bearing cover 74 beneath it. The T-like bearing cover 74 is fixed to the guide element by means of bolts 75. A gasket 78 is placed between the T-like bearing cover 73 and the top end of the first sleeve 70. An O-ring 79 is placed on the top of the guide element 72 for the spindle 71 to pass through the T-like bearing cover 74, the bearing 73 and the top of the guide element 72, and is retained by a retainer ring 77 that fits in an annular groove 76 on the spindle 71.

Figure 5:
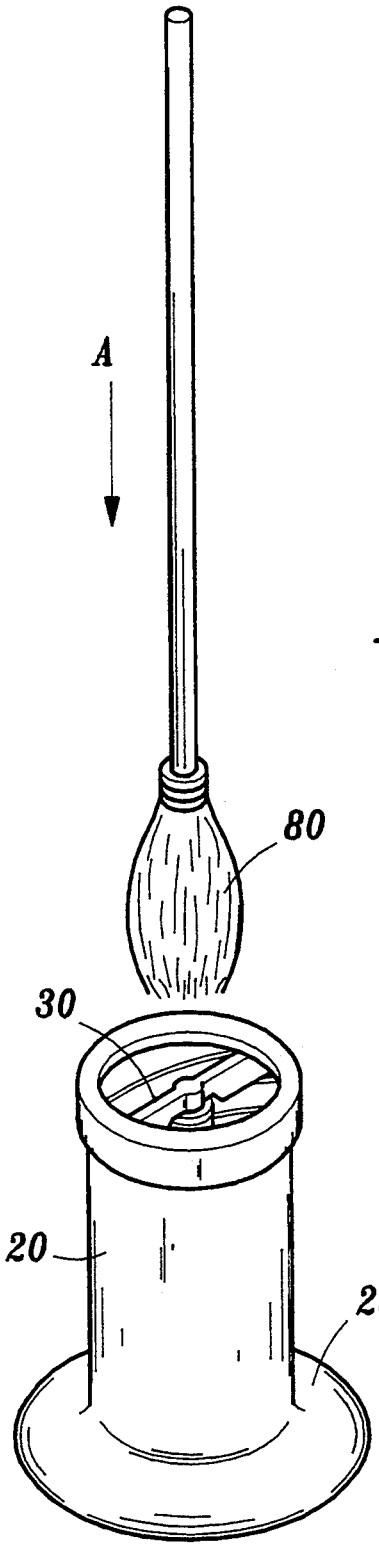
FIG. 5 is a perspective view of the dewatering device for a swab according to the present invention just prior to a swab being placed therein.
Figure 6A:
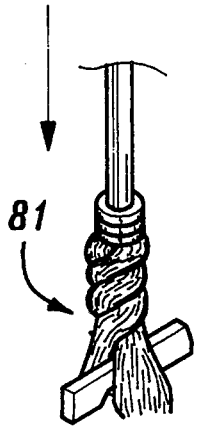
FIG. 6A illustrates twisting of the swab according to the present invention.
Figure 6:
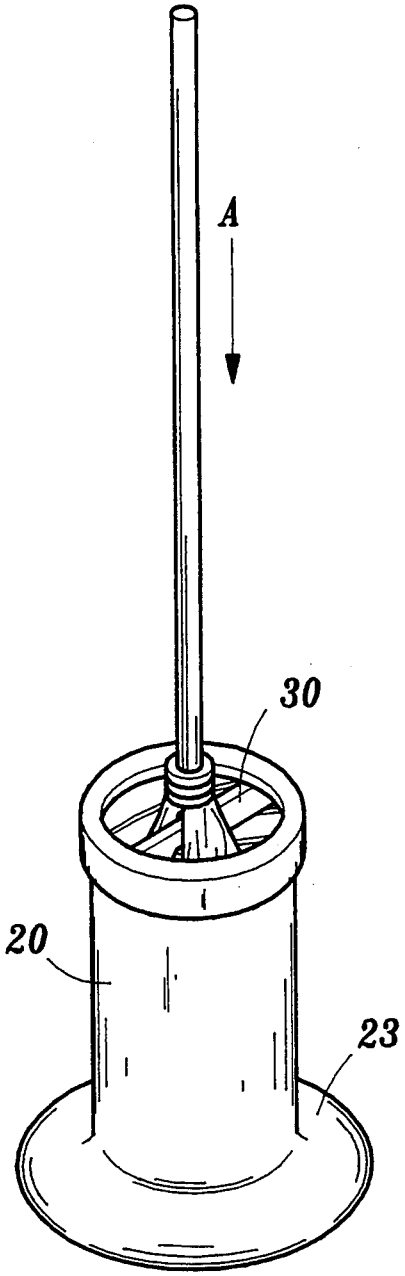
FIG. 6 is a perspective view of the dewatering device for a swab according to the present invention with a swab inserted therein.

Please refer to FIGS. 5 and 6 which illustrate the operation of the present invention. A swab 80 is placed in a way that it is separated by the guide element 30 and a downward force is applied in the direction of the arrow A. Then, the guide element 30 rotates and twists the swab 80 to a shape like a twisted rope 81 as shown in FIG. 6A to extract water from the swab 80. The water so extracted is discharged through a plurality of discharge holes 22 at the bottom of the body 20. The expansion pipe 40 is incorporated with compression springs 50 and 50' to provide a return force to return the guide element 30 to its original position. By repeating the twisting several times, the swab 80 can be dewatered. The body 20 according to the present invention is designed with a large bottom 23 that can be stepped to prevent body 20 from turning over, even during an improper application of force.

Many changes and modifications in the above described embodiments of the invention can of course, be carried out without departing from the scope of the invention. Accordingly, to promote the progress in science and the useful arts, the invention is disclosed and is intended to be limited only by the scope of the appended claims.

What is claimed is:

1. A dewatering device for a swab of the type that includes strands which may be twisted to cause the removal of water therefrom comprising:

a body including a hollow upper body portion and an enlarged lower body portion, said upper body portion including inner and outer wall surfaces, said outer wall surface being externally threaded at an uppermost portion thereof, said upper body portion being formed with a spiral groove that extends along said inner wall surface, said body further including a plurality of drain holes opening into said hollow upper body portion and extending through said lower body portion;

an expansion pipe assembly positioned within said hollow upper body portion and secured to said lower body portion, said expansion pipe assembly including first, second and third sleeves, means telescopingly interconnecting said first, second and third sleeves for movement between extended and retracted positions and spring means biasing said first, second and third sleeves to said extended position, each of said first, second and third sleeves including upper and lower ends, the upper end of said second sleeve being formed with an outer lug that engages an inner lug formed at the lower end of said first sleeve and the upper end of said third sleeve being formed with an outer lug that engages an inner lug formed at the lower end of said second sleeve when said first, second and third sleeves are in said extended position, said first sleeve being threaded on an outer surface of its upper end;

a support member including an internally threaded portion threadably secured to the upper end of said first sleeve and an externally threaded portion, said support member further including a centrally located recess;

a bearing unit positioned within the centrally located recess of said support member, said bearing unit including a central bore;

a cover member threadably attached to the externally threaded portion of said support member, said cover member including a centrally located hole aligned with the central bore of said bearing unit;

a guide element secured within the hollow upper body portion of said body, said guide element including opposing lateral sides, each of said lateral sides being formed with a guide hole, said guide element further including a spindle projecting from a central portion thereof, said spindle extending through the centrally located hole of said cover member and the central bore of said bearing unit;

a pair of guide devices each of which is received within a respective one of the guide holes of said guide element, each of said guide devices including a portion that projects into said spiral groove; and an internally threaded cover that is threadably attached to the externally threaded uppermost portion of said body, whereby said dewatering device is adapted to receive a swab with strands of the swag extending over said guide element such that, when the swab is pushed into the body of the dewatering device, the guiding element will rotate from a non-use position due to the engagement between the guide devices and the spiral groove so as to cause the expansion pipe to telescope within the hollow upper body portion against the biasing force of said spring means and strands of the swab to be twisted in order to remove water therefrom which exits the body of the dewatering device through the plurality of draining holes and, upon removal of the swab from the dewatering device, the spring means causes the guiding element to be repositioned to its non-use position.

2. A dewatering device for a swab as claimed in claim 1, wherein each of the guide devices comprises a ball and a compression spring.

3. A dewatering device for a swab as claimed in claim 1, wherein each of the guide devices comprises a ball, a T-block and a compression spring.

4. A dewatering device for a swab as claimed in claim 1, wherein each of the guide devices comprises a T-block and a compression spring.

5. A dewatering device for a swab as claimed in claim 1, wherein the second and third sleeves of said expansion pipe are hollow and said spring means comprise a single compression spring that extends within the first, second and third sleeves.

6. A dewatering device for a swab as claimed in claim 1, wherein the upper end of each of said second and third sleeves is closed by a substantially flat end wall, said spring means including a first compression spring positioned within said first sleeve between said support member and the end wall of said second sleeve and a second compression spring positioned within said second sleeve between the end wall of said second sleeve and the end wall of said third sleeve.

7. A dewatering device for a swab of the type that includes strands which may be twisted to cause the removal of water therefrom comprising:

a body including a hollow upper body portion and an enlarged lower body portion, said upper body portion including inner and outer wall surfaces, said outer wall surface being externally threaded at an uppermost portion thereof, said upper body portion being formed with a spiral groove that extends along said inner wall surface, said body further including a plurality of drain holes opening into said hollow upper body portion and extending through said lower body portion;

a guide element secured within the hollow upper body portion of said body, said guide element including opposing lateral sides, each of said lateral sides being formed with a guide hole, said guide element further including a hole at a central lower portion thereof and a recess formed therein about said hole;

a bearing unit positioned within the recess of said guide element, said bearing unit including a central bore aligned with the hole formed in said guide element;

a cover member secured to said guide element and extending over said recess so as to maintain said bearing unit within said recess, said cover member including an aperture aligned with the central bore of said bearing unit;

an expansion pipe assembly positioned within said hollow upper body portion and secured to said lower body portion, said expansion pipe assembly including first, second and third sleeves, means telescopingly interconnecting said first, second and third sleeves for movement between extended and retracted positions and spring means biasing said first, second and third sleeves to said extended position, each of said first, second and third sleeves including upper and lower ends, the upper end of said first sleeve being closed by means of an end wall and including a spindle projecting from said end wall, said spindle extending through the aperture in said cover member, through the central bore of said bearing unit and into the aligned hole of said guide element, the upper end of said second sleeve being formed with an outer lug that engages an inner lug formed at the lower end of said first sleeve and the upper end of said third sleeve being formed with an outer lug that engages an inner lug formed at the lower end of said second sleeve when said first, second and third sleeves are in said extended position;

a pair of guide devices each of which is received within a respective one of the guide holes of said guide element, each of said guide devices including a portion that projects into said spiral groove; and an internally threaded cover that is threadably attached to the externally threaded uppermost portion of said body, whereby said dewatering device is adapted to receive a swab with strands of the swag extending over said guide element such that, when the swab is pushed into the body of the dewatering device, the guiding element will rotate from a non-use position due to the engagement between the guide devices and the spiral groove so as to cause the expansion pipe to telescope within the hollow upper body portion against the biasing force of said spring means and strands of the swab to be twisted in order to remove water therefrom which exits the body of the dewatering device through the plurality of draining holes and, upon removal of the swab from the dewatering device, the spring means causes the guiding element to be repositioned to its non-use position.

8. A dewatering device for a swab as claimed in claim 7, wherein each of the guide devices comprises a ball and a compression spring.

9. A dewatering device for a swab as claimed in claim 7, wherein each of the guide devices comprises a ball, a T-block and a compression spring.

10. A dewatering device for a swab as claimed in claim 7, wherein each of the guide devices comprises a T-block and a compression spring.

11. A dewatering device for a swab as claimed in claim 7, wherein the second and third sleeves of said expansion pipe are hollow and said spring means comprise a single compression spring that extends within the first, second and third sleeves.

12. A dewatering device for a swab as claimed in claim 7, wherein the upper end of each of said second and third sleeves is closed by a substantially flat end wall, said spring means including a first compression spring positioned within said first sleeve between said support member and the end wall-of said second sleeve and a second compression spring positioned within said second sleeve between the end wall of said second sleeve and the end wall of said third sleeve.

* * * * *